US011284763B2

(12) United States Patent
Cheng

(10) Patent No.: US 11,284,763 B2
(45) Date of Patent: Mar. 29, 2022

(54) DUST COLLECTOR WITH CONVENIENT LOADING AND UNLOADING DUST COLLECTING BARREL

(71) Applicant: San Ford Machinery Co., Ltd., Taichung (TW)

(72) Inventor: Yuan-Tai Cheng, Taichung (TW)

(73) Assignee: SAN FORD MACHINERY CO., LTD., Taichung (TW)

( * ) Notice: Subject to any disclaimer, the term of this patent is extended or adjusted under 35 U.S.C. 154(b) by 127 days.

(21) Appl. No.: 16/943,796

(22) Filed: Jul. 30, 2020

(65) Prior Publication Data

US 2022/0031135 A1 Feb. 3, 2022

(51) Int. Cl.

| | |
|---|---|
| ***A47L 9/24*** | (2006.01) |
| ***A47L 9/32*** | (2006.01) |
| ***A47L 9/16*** | (2006.01) |

(52) U.S. Cl.

CPC ..... *A47L 9/244* (2013.01); *A47L 9/1683* (2013.01); *A47L 9/32* (2013.01)

(58) Field of Classification Search

CPC ..... A47L 9/244; A47L 9/1683; A47L 9/32

See application file for complete search history.

(56) References Cited

U.S. PATENT DOCUMENTS

2017/0245709 A1* 8/2017 Costello ..... A47L 9/246

* cited by examiner

*Primary Examiner* — Andrew A Horton

(74) *Attorney, Agent, or Firm* — Sinorica LLC

(57) ABSTRACT

A dust collector with convenient loading and unloading dust collecting barrel includes a base plate fixed on an outer periphery of a bottom of an air guide cylinder, an operation unit whose end is pivotally arranged on the base plate, linking members disposed on said operation unit and connected to a dust collecting barrel lid located under the air guide tube. Accordingly, when a user lifts up the operation unit, the linking members move the dust collecting barrel lid upwards. The upward movement separates the dust collecting barrel lid from the dust collecting barrel, so the dust collecting barrel is easily detached. The action of swinging the operation unit swings down allows the linking members to move the dust collecting barrel lid downwards, so the dust collecting barrel lid closes the dust collecting barrel. Therefore, the user loads and unloads the dust collecting barrel quickly and conveniently.

10 Claims, 7 Drawing Sheets

DUST COLLECTOR WITH CONVENIENT LOADING AND UNLOADING DUST COLLECTING BARREL

BACKGROUND OF THE INVENTION

1. Field of the Invention

This invention relates to a dust collecting device and relates particularly to a dust collector capable of assisting the user in loading and unloading a dust collecting barrel quickly and conveniently.

2. Description of the Related Art

Generally, a dust collecting device is usually used to collect and filter dirt and harmful substances in a working site where dust or substances harmful to health may be generated. The dust collecting device functions to reduce dust and harmful substances in the environment and helps decrease the hazard to human health. Referring to FIG. 1, a conventional dust collecting device includes a frame 901, a wind box 906 disposed on the frame 901, a filtering cylinder 908 disposed at an outlet of the wind box 906, a motor 907 disposed on the wind box 906 and adapted to create absorbing force caused by negative pressure, an air guide cylinder 903 disposed at the bottom of the wind box 906 and located at a place relative to the motor 907, a gas inlet 902 disposed on the periphery of the air guide cylinder 903 and adapted to absorb dirty air and dust from the external environment, and a dust collecting barrel 905 connected to the bottom of the air guide cylinder 903. When the motor 907 operates, the dirty air and dust can be introduced from the gas inlet 902 into the air guide cylinder 903 by the absorbing force. The air containing dust creates vortices along an inner wall of the air guide cylinder 903 whereby dust falls towards the dust collecting barrel 905. Then, gas flow passes the wind box 906 and enters the filtering cylinder 908 by the absorbing force of the motor 907. Finally, the gas flow is filtered by the filtering cylinder 908 and then discharged after the filtering process is done.

If the conventional dust collecting device has been used for a long time, the accumulation of dust would have been caused. This requires cleaning of the dust collecting barrel 905. Thus, a detachable dust collecting barrel lid 904 is generally added to the dust collecting barrel 905. Accordingly, a large number of fastening members 909 may be disposed on the periphery of the dust collecting barrel lid 904 and adapted to fasten the lid 904 to the dust collecting barrel 905 in an airtight manner in order to prevent dust within the dust collecting barrel 905 from overflowing during the operation of the dust collecting device. However, the detachment or installation of the fastening members 909 may take a lot of time to unload or load the dust collecting barrel 905. Particularly, if the dust collecting device abuts against the wall or is situated on the corner, it is difficult to operate the device and the inconvenience is caused. Therefore, the primary subject of this invention is to find a solution to the problem of inconvenient detachment and installation of the dust collecting barrel of the conventional dust collecting device.

SUMMARY OF THE INVENTION

An object of this invention is to provide a dust collector capable of assisting the user in loading and unloading the dust collecting barrel quickly and conveniently.

To achieve the object, a dust collector with convenient loading and unloading duct collecting barrel of this invention includes a frame, a wind box disposed on the frame, a motor disposed on the wind box, an air guide cylinder disposed at a bottom of the wind box and situated relative to the motor, a gas inlet disposed on a periphery of the air guide cylinder, a telescopic tube connected to a bottom of the air guide cylinder, a dust collecting barrel lid connected to the other end of the telescopic tube, and a dust collecting barrel disposed under the dust collecting barrel lid. It is characterized in that the dust collector of this invention includes elements described as follows.

A base plate is fixed on an outer periphery of the bottom of the air guide cylinder, and two pivot ears each are disposed at a rear side of the base plate.

An operation unit is disposed in front of the frame. An end of the operation unit is pivotally connected to the two pivot ears of the base plate, and the operation unit extends towards the other side of the base plate.

A plurality of linking members can be provided. One end of each linking member is pivotally connected to the operation unit, and the other end of each linking member is pivotally connected to the dust collecting barrel lid.

Accordingly, the linking members are driven by the operation unit to move the dust collecting barrel lid upwards and downwards. When a user wants to unload the dust collecting barrel, he only needs to lift the operation unit up. This upward movement allows the linking members to move the dust collecting barrel lid upwards, thereby separating the dust collecting barrel lid from the dust collecting barrel. Thus, the dust collecting barrel is easily detached. When the user wants to load the dust collecting barrel, he only needs to swing the operation unit down. This downward swinging action allows the linking members to move the dust collecting barrel lid downwards, thereby closing the dust collecting barrel with the dust collecting barrel lid. It is noted that the dust collecting barrel lid can be forcedly attached to the dust collecting barrel by the gravity of the operation unit, which assists the user in loading and unloading the dust collecting barrel quickly and conveniently and increases the working efficiency greatly.

DETAILED DESCRIPTION OF THE PREFERRED EMBODIMENTS

Figure 1:
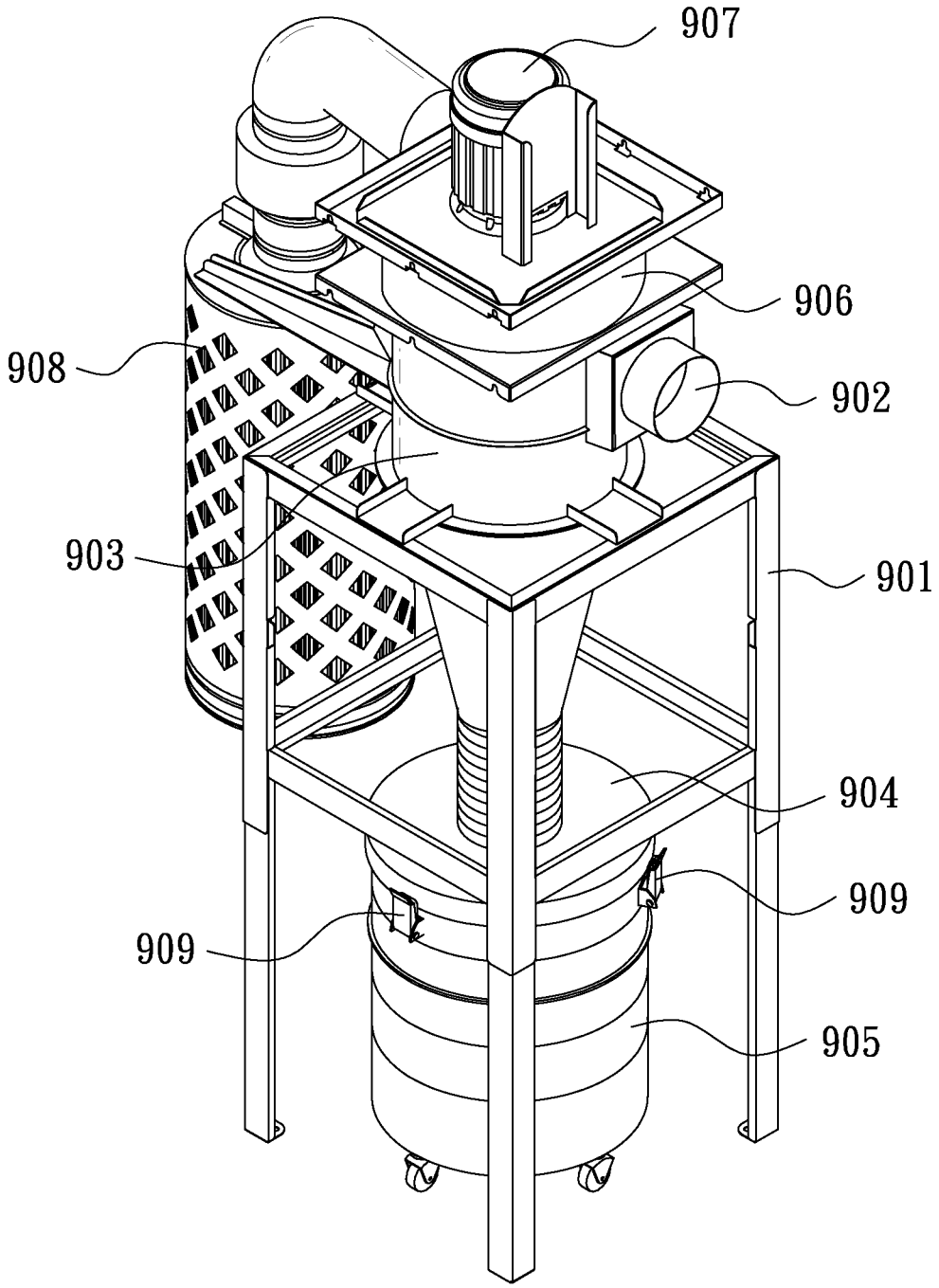
FIG. 1 is a perspective view showing a convention dust collecting device.
Figure 2:
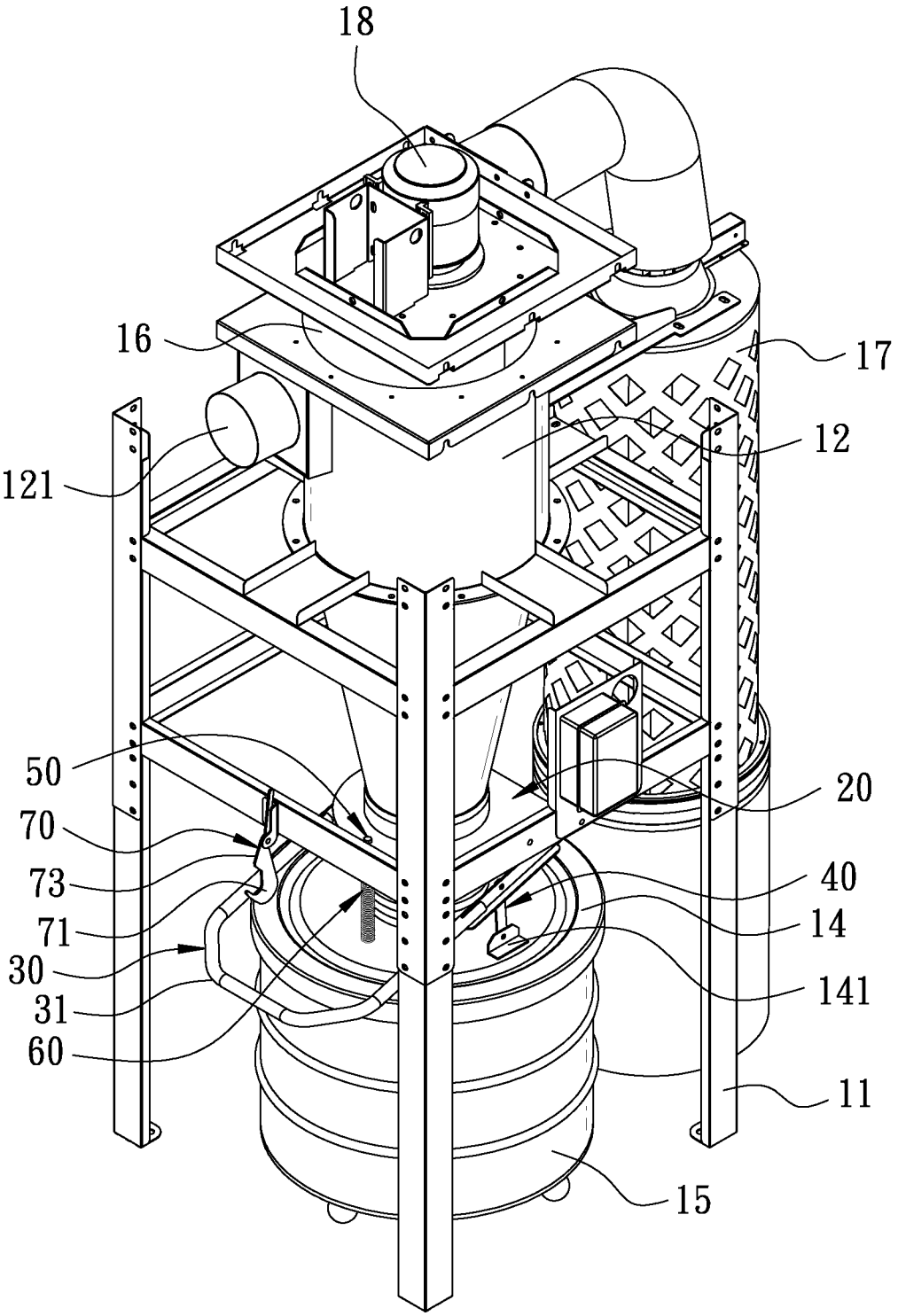
FIG. 2 is a perspective view a preferred embodiment of this invention.
Figure 3:
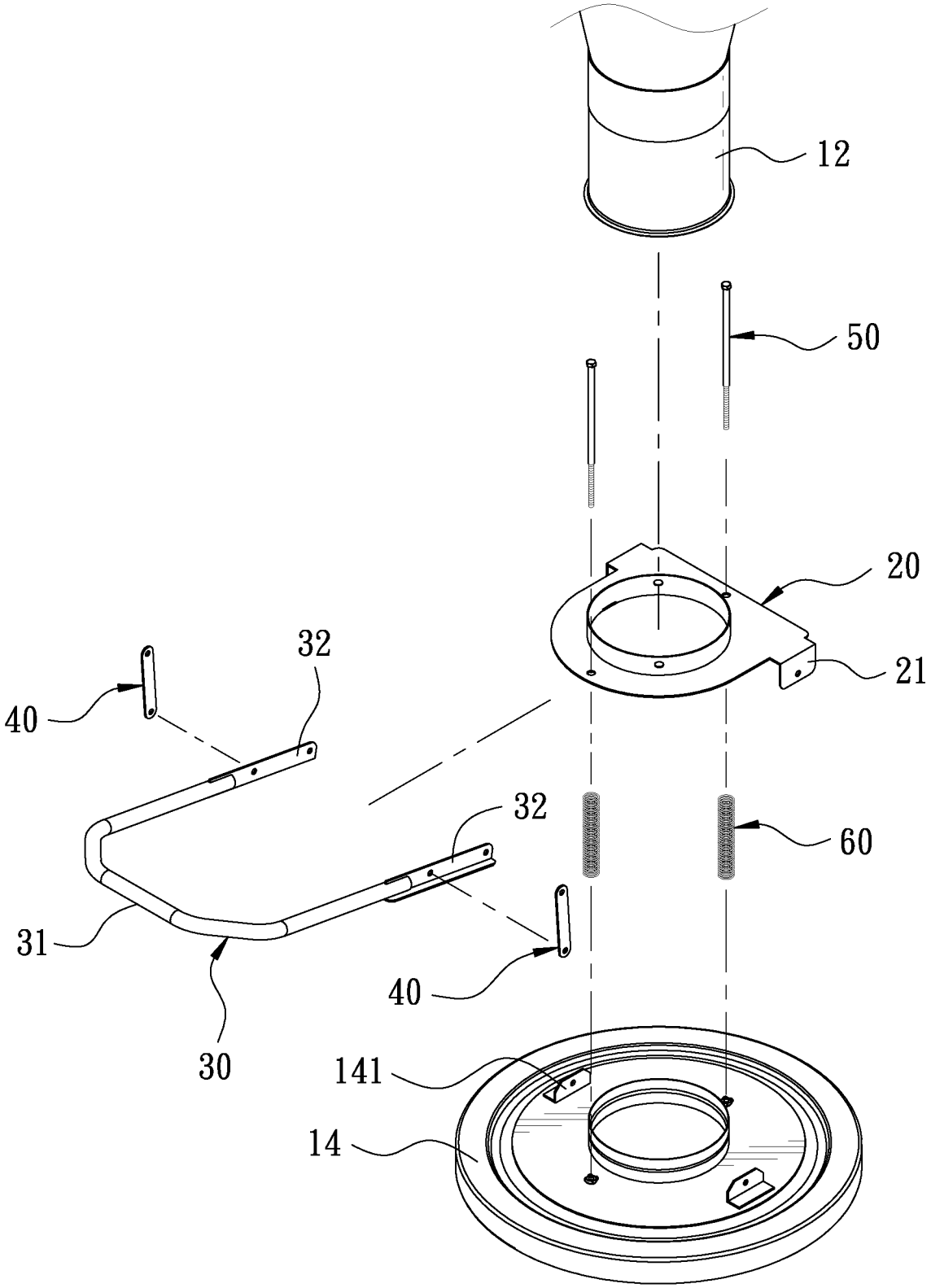
FIG. 3 is a partial exploded view showing elements of the loading and unloading mechanism of the preferred embodiment of this invention.
Figure 4:
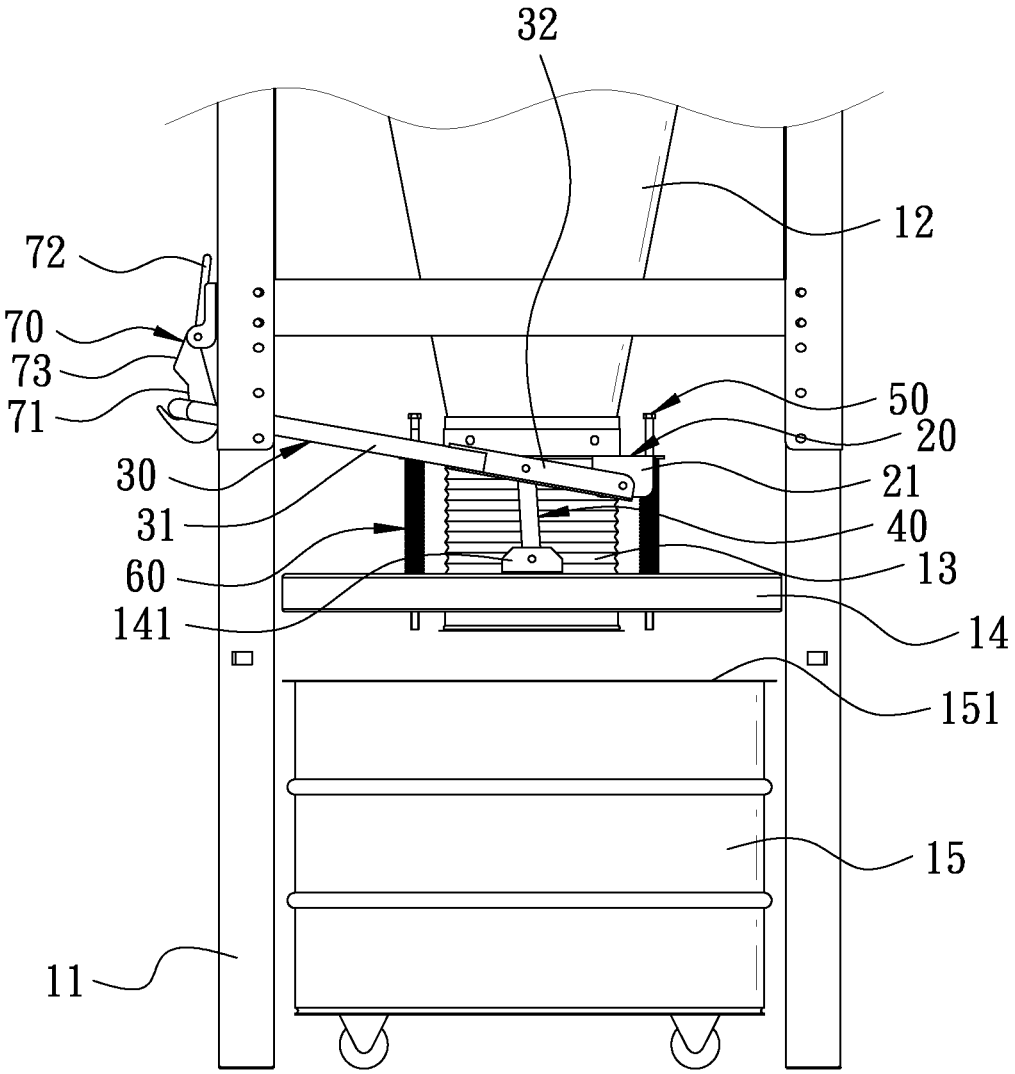
FIG. 4 is a schematic view showing the status of the preferred embodiment before loading a dust collecting barrel onto a dust collector.

Referring to FIGS. 2 to 4, a preferred embodiment of a dust collector with convenient loading and unloading dust collecting barrel of this invention is disclosed and mainly includes following elements.

A frame 11 on which a dust collector is installed is disposed.

A wind box 16 is disposed on the frame 11. A room is enclosed by an interior of the wind box 16 and defined as a gas flow channel.

A filtering cylinder 17 is disposed at an outlet of the wind box 16 and adapted to filter and then discharge clean air. A filtering substance is disposed inside the filtering cylinder 17. The filtering substance can be HEPA (High efficiency particulate air filter), activated charcoal, or other suitable materials to subject air passing the filtering substance to purifying treatment, filtering treatment, deodorizing treatment, etc.

A motor 18 is disposed on the wind box 16 and adapted to create absorbing force caused by negative pressure, thereby forming a steering flow inside the wind box 16.

An air guide cylinder 12 is disposed at a bottom of the wind box 16 and situated at a place relative to the motor 18. A gas inlet 121 is disposed on a periphery of the air guide cylinder 12 for introducing dirty air and dust from the external environment. An inner wall of the air guide cylinder 12 helps steer gas flow for creating vortices whereby dust contained in the vortices falls towards a bottom of the air guide cylinder 12.

A dust collecting barrel 15 is disposed under the air guide cylinder 12 and adapted to collect and store the dust dropping from the air guide cylinder 12 temporarily. An airtight cushion 151 is disposed on a top edge of the dust collecting barrel 15. The airtight cushion 151 is made of an elastic and deformable material, such as rubber.

A dust collecting barrel lid 14 is adapted to cover the dust collecting barrel 15 for closing the dust collecting barrel 15. The dust collecting barrel lid 14 closes the dust collecting barrel 15 in an airtight manner by using the airtight cushion 151. There can be a plurality of pivot seats 141 protruding from a top portion of the dust collecting barrel lid 14, and the pivot seats 141 are symmetric. In this preferred embodiment, the pivot seats 141 are arranged at a place corresponding to a middle part of the dust collecting barrel lid 14.

A telescopic tube 13 is disposed. One end of the telescopic tube 13 is disposed at the bottom of the air guide cylinder 12, and the other end thereof is disposed on the dust collecting barrel lid 14. When the dust collecting barrel lid 14 closes the dust collecting barrel 15, the dust collecting barrel 15 is in communication with the bottom of the air guide cylinder 12 by using the telescopic tube 13.

A base plate 20 is fixed on an outer periphery of the bottom of the air guide cylinder 12. Two pivot ears 21 each are disposed at a rear side of the base plate 20.

An operation unit 30 includes a holding bar 31 and two connecting stems 32. One end of each connecting stem 32 is pivotally connected to each pivot ear 21 of the base plate 20, and the other end thereof extends towards the other side of the base plate 20. The holding bar 31 is formed in a U shape and spans the base plate 20. Two ends of the holding bar 31 each are fixed to the other end of each connecting stem 32.

A plurality of linking members 40 can be provided. One end of each linking member 40 is pivotally connected to the connecting stem 32 of the operation unit 30, and the other end thereof is pivotally connected to the pivot seat 141 of the dust collecting barrel lid 14. The linking members 40 are symmetric. In this preferred embodiment, the linking members 40 are disposed relative to the pivot seats 141 and arranged at a place corresponding to the middle part of the dust collecting barrel lid 14.

A plurality of position limiting stems 50 can be provided. One end of each position limiting stem 50 is fixed onto the top portion of the dust collecting barrel lid 14, and the other end thereof penetrates through the base plate 20, so the position limiting stem 50 is adapted to slide among the base plate 20. The position limiting stems 50 are symmetric.

A plurality of springs 60 can be provided. The springs 60 each are defined as a compression spring. Each of the springs 60 is sleevedly disposed on each of the position limiting stems 50. An upper end of the spring 60 is braced against a bottom portion of the base plate 20 and a lower end of which is braced against the top portion of the dust collecting barrel lid 14, thereby adding downward pushing force.

A holding member 70 is pivotally connected to the frame 11. A hook 71 is disposed at a lower end so that the holding member 70 becomes a hook plate slightly formed in a J shape for holding and fastening the holding bar 31 of the operation unit 30. In this preferred embodiment, a front edge of the holding member 70 is provided with a guide bevel 73 situated above the hook 71, and the guide bevel 73 is defined as a sloping surface gradually extending forward from top to bottom, namely from an upper position to a lower position. Accordingly, a user abuts the holding bar 31 against the guide bevel 73 to move the holding member 70 backwards and then allow the holding bar 31 to enter the hook 71. Thus, the hook 71 catches and fastens the holding bar 31. Furthermore, the hook 71 includes a handle 72 by which the user presses the holding member 70 with hands directly to separate the holding bar 31 from the hook 71.

The structural features, technique, and objects of the present invention over the known prior arts will become more apparent to those of ordinary skilled in the art by reading the descriptions as follows.

Figure 5:
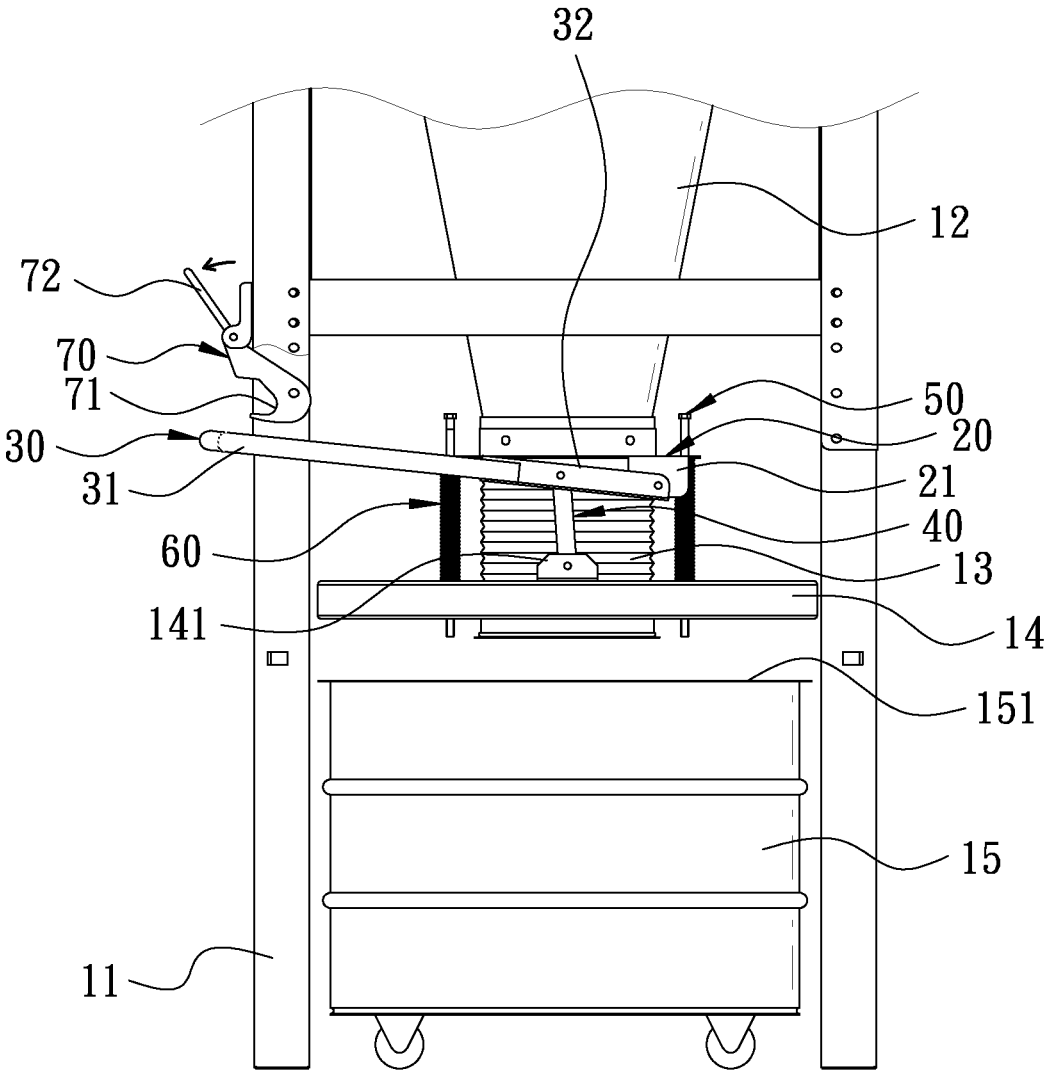
FIG. 5 is a schematic view showing that the loading and unloading mechanism of the preferred embodiment gets ready to load the dust collecting barrel.
Figure 6:
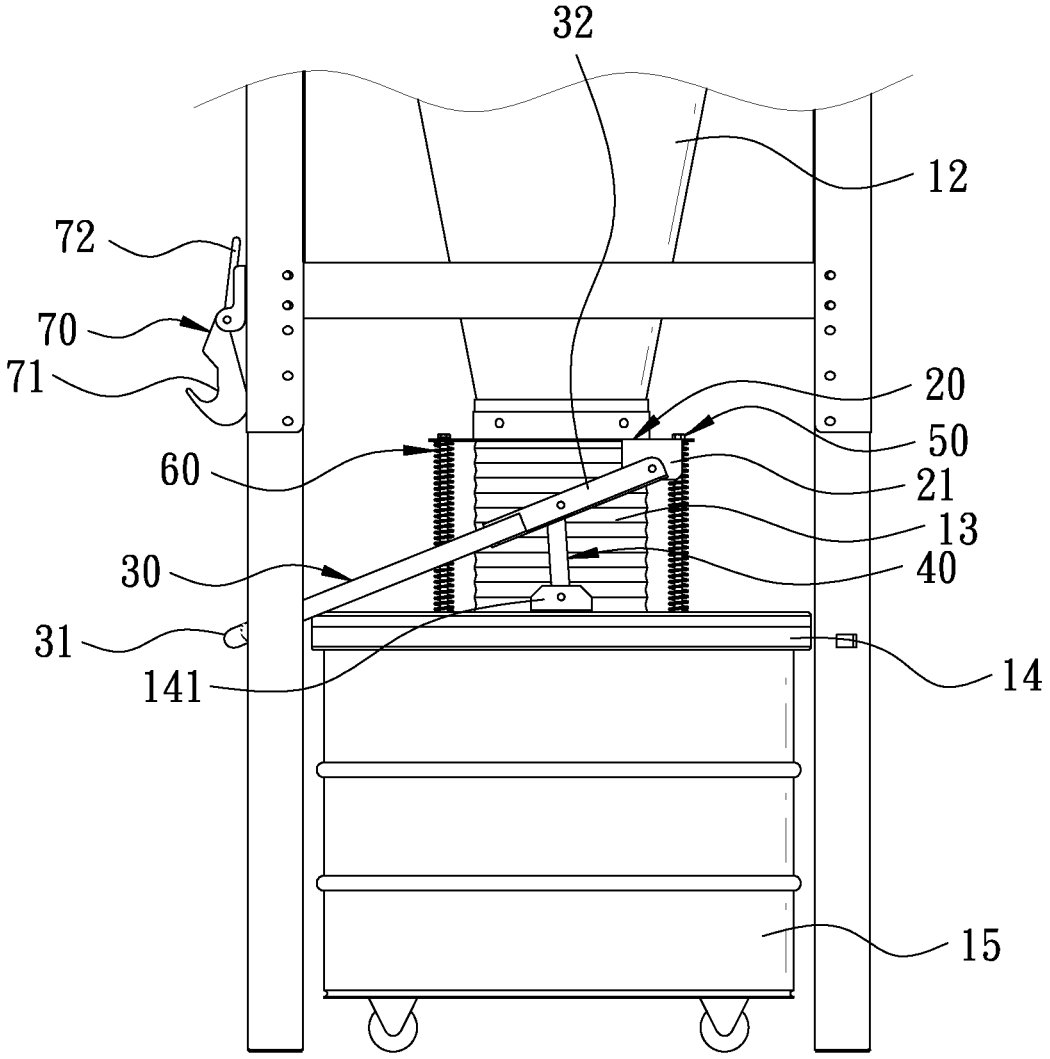
FIG. 6 is a schematic view showing that a dust collecting barrel lid of the preferred embodiment presses down in a perfect airtight manner.

Referring to FIGS. 4 to 6, when a user wants to load the dust collecting barrel 15 onto the dust collector, he needs to lift the holding bar 31 up and makes the hook 71 of the holding member 70 catch the holding bar 31. This action allows the holding bar 31 to hold the dust collecting barrel lid 14 in position. Then, the dust collecting barrel 15 is pushed to a place under the dust collecting barrel lid 14. Afterwards, the user presses the handle 72 of the holding member 70 with their hands directly to turn the holding member 70. The turning action of the holding member 70 separates the holding bar 31 from the hook 71. The gravity of the holding bar 31 makes the holding bar 31 swing downwards. The user can also move the holding bar 31 downwards. This downward motion allows the linking members 40 to move the dust collecting barrel lid 14 downwards. Finally, the dust collecting barrel lid 14 closes the dust collecting barrel 15.

It is noted that the dust collecting barrel lid 14 can be forcedly attached to the dust collecting barrel 15 because of the gravity of the holding bar 31, and the spring force of the springs 60 added to the dust collecting barrel lid 14 can increase the airtight effect between the dust collecting barrel lid 14 and the dust collecting barrel 15.

Figure 7:
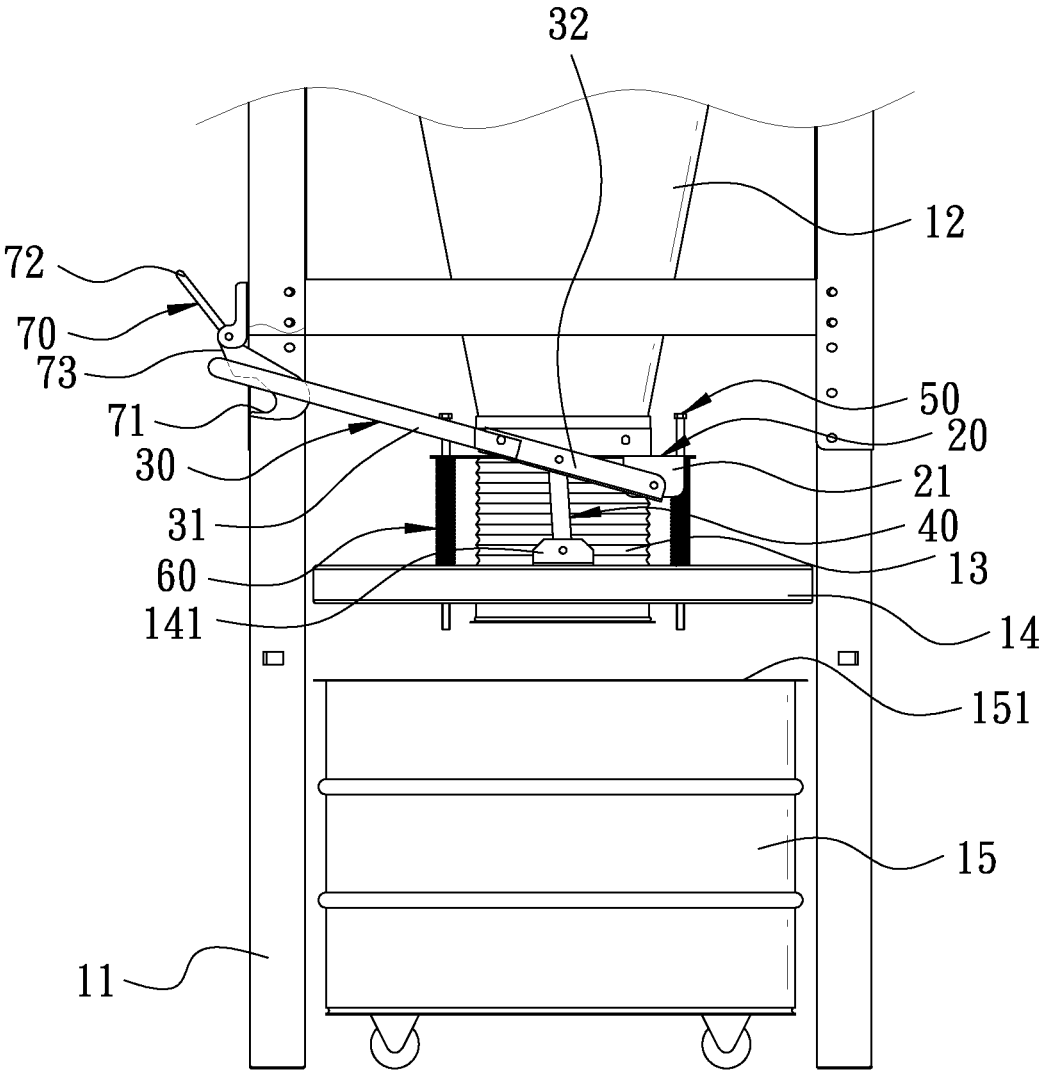
FIG. 7 is a perspective view showing the operation of the preferred embodiment for fastening the loading and unloading mechanism by using a holding member.

Referring to FIG. 7, when the user wants to detach the dust collecting barrel 15 from the dust collector, he needs to pull the holding bar 31 up and operates the linking members 40 to move the dust collecting barrel lid 14 upwards and then separate the dust collecting barrel lid 14 from the dust collecting barrel 15. This action allows the user to pull the dust collecting barrel 15 out easily and facilitates the processes of replacing and cleaning the dust collecting barrel 15. When the user lifts the holding bar 31 up and puts it onto the holding member 70, the guide bevel 73 assists the holding bar 31 in entering the hook 71 to allow the holding bar 31 to hang on the hook 71 of the holding member 70.

Thus, the holding bar 31 hold the dust collecting barrel lid 14 in position to facilitate the process of loading and unloading the dust collecting barrel 15.

The features and advantages of this invention are described as follows.

Regarding the dust collector with convenient loading and unloading dust collecting barrel of this invention, the operation unit is lifted up and the linking members are driven to move the dust collecting barrel lid upwards, thereby separating the dust collecting barrel lid from the dust collecting barrel. Thus, the dust collecting barrel can be easily detached.

Regarding the dust collector with convenient loading and unloading dust collecting barrel of this invention, the user only needs to make the dust collecting barrel position under the dust collecting barrel lid and then swings down the operation unit to allow the linking members to move the dust collecting barrel lid downwards. Thus, the dust collecting barrel lid closes the dust collecting barrel. It is noted that the gravity caused by the downward swinging of the operation unit can render the dust collecting barrel lid able to be forcedly attached to the dust collecting barrel.

Therefore, this invention assists the user in loading and unloading the dust collecting barrel in a quick and convenient manner and increases working efficiency greatly.

To sum up, the features of this invention achieve a preferable object and purpose by comparison with other products in the same field. These features do not appear to be disclosed or rendered obvious by any relevant prior documents in domestic and foreign countries. Thus, the subject matter of this invention appears to be new and involves an inventive step.

While the embodiments are shown and described above, it is understood that the embodiments related to this invention should not limit the scope of this invention and that further variations and modifications may be made without departing from the scope of this invention.

What is claimed is:

1. A dust collector with convenient loading and unloading duct collecting barrel comprising a frame, a wind box disposed on said frame, a motor disposed on said wind box, an air guide cylinder disposed at a bottom of said wind box and situated relative to said motor, a gas inlet disposed on a periphery of said air guide cylinder, a telescopic tube connected to a bottom of said air guide cylinder, a dust collecting barrel lid connected to the other end of said telescopic tube, and a dust collecting barrel disposed under said dust collecting barrel lid;

wherein said dust collector comprises:

a base plate fixed on an outer periphery of said bottom of said air guide cylinder, two pivot ears each being disposed at a rear side of said base plate;

an operation unit disposed in front of said frame, one end of said operation unit being pivotally connected to said two pivot ears of said base plate, said operation unit extending towards the other side of said base plate; and a plurality of linking members, with one end of each of said plurality of linking members pivotally connected to said operation unit, and the other end of each of said plurality of linking members pivotally connected to said dust collecting barrel lid;

wherein said plurality of linking members are driven by said operation unit to move said dust collecting barrel lid upwards and downwards, thereby allowing a user to load and unload said dust collecting barrel quickly and conveniently.

2. The dust collector with convenient loading and unloading duct collecting barrel according to claim 1, wherein said operation unit includes a holding bar and two connecting stems, one end of each of said two connecting stems being pivotally connected to each of said two pivot ears, and the other end thereof extending towards said other side of said base plate, two ends of said holding bar each being fixed to said other end of each of said two connecting stems.

3. The dust collector with convenient loading and unloading duct collecting barrel according to claim 2, wherein said one end of each of said plurality of linking members is pivotally connected to each of said plurality of connecting stems, and said other end thereof is pivotally connected to said dust collecting barrel lid.

4. The dust collector with convenient loading and unloading duct collecting barrel according to claim 1, further comprising a plurality of springs, said plurality of springs each being defined as a compression spring, an upper end of which is braced against a bottom portion of said base plate and a lower end of which is braced against a top portion of said dust collecting barrel lid, and said plurality of springs thereby being adapted to add downward pushing force.

5. The dust collector with convenient loading and unloading duct collecting barrel according to claim 4, further comprising a plurality of position limiting stems, one end of each of said plurality of position limiting stems being fixed onto said top portion of said dust collecting barrel lid, the other end of each of said plurality of position limiting stems penetrating through said base plate, and said plurality of position limiting stems thereby being adapted to slide among said base plate, said plurality of springs being sleevedly disposed around said plurality of position limiting stems respectively.

6. The dust collector with convenient loading and unloading duct collecting barrel according to claim 1, further comprising a holding member disposed on said frame and adapted to hold and fasten said operation unit.

7. The dust collector with convenient loading and unloading duct collecting barrel according to claim 6, wherein said holding member is pivotally connected to said frame, a handle being disposed at an upper end of said holding member, a hook being disposed at a lower end of said holding member.

8. The dust collector with convenient loading and unloading duct collecting barrel according to claim 7, wherein a front edge of said holding member is provided with a guide bevel situated above said hook, said guide bevel being defined as a sloping surface gradually extending forward from top to bottom.

9. The dust collector with convenient loading and unloading duct collecting barrel according to claim 1, wherein a plurality of pivot seats are disposed on a top portion of said dust collecting barrel lid, said other end of each of said plurality of linking members being pivotally connected to each of said plurality of pivot seats.

10. The dust collector with convenient loading and unloading duct collecting barrel according to claim 1, wherein an airtight cushion is disposed on a top edge of said dust collecting barrel.

* * * * *